United States Patent [19]

Zettier

[11] Patent Number: 4,505,700

[45] Date of Patent: Mar. 19, 1985

[54] CENTRIFUGE WITH A SELF-EMPTYING DRUM

[75] Inventor: Karl-Heinz Zettier, Oelde, Fed. Rep. of Germany

[73] Assignee: Westfalia Separator AG, Oelde, Fed. Rep. of Germany

[21] Appl. No.: 569,015

[22] Filed: Jan. 9, 1984

[30] Foreign Application Priority Data

Feb. 16, 1983 [DE] Fed. Rep. of Germany ..... 3305216

[51] Int. Cl.[3] ..... B04B 11/04

[52] U.S. Cl. ..... 494/30; 494/40

[58] Field of Search ..... 494/2, 3, 4, 25, 26, 494/27, 29, 30, 40, 48

[56] References Cited

U.S. PATENT DOCUMENTS

| | | | |
|---|---|---|---|
| 3,550,843 | 12/1970 | Hoffmann | 494/27 |
| 3,749,303 | 7/1973 | Hemfort | 494/40 |
| 3,754,701 | 8/1973 | Bruning | 494/40 |
| 3,871,575 | 3/1975 | Niemeyer | 494/48 |
| 3,878,981 | 4/1975 | Teckentrup | 494/48 |
| 3,940,056 | 2/1976 | Schmidt | 494/27 |
| 4,284,233 | 8/1981 | Külker | 494/48 |

*Primary Examiner*—Robert W. Jenkins

*Assistant Examiner*—Arthur D. Dahlberg

*Attorney, Agent, or Firm*—Sprung, Horn, Kramer & Woods

[57] ABSTRACT

A centrifuge has ejection openings in the jacket of the drum to which channels extending from the solids space lead. The flow through the channels can be blocked off by an annular valve body. A closure compartment is associated with the valve body. Closure fluid is supplied to the closure compartment through a line from a catch gutter. The line consists of two connected components. The components can be separated by a piston with a flowthrough channel. When the piston is in the separating position, in which it blocks off an opening in the first line component, the flowthrough channel connects the second line component with an off-flow channel that is open to the atmosphere. In this position the second line component and the closure compartment are depressurized so that the valve body can move into an opening position. This opening motion is reinforced with opening water conveyed through three channels to an opening chamber. The first channel communicates with the second channel, which supplies opening water to the extensive active surface of the piston when the piston is to be moved into the separating position in which its smaller active surface blocks off the opening.

9 Claims, 2 Drawing Figures

CENTRIFUGE WITH A SELF-EMPTYING DRUM

BACKGROUND OF THE INVENTION

The present invention relates to a centrifuge with a self-emptying drum having ejection openings in the jacket that open off of channels extending from the solids space and that can be blocked off by an annular valve body, a closure compartment associated with the valve body, and closure fluid supplied to the closure compartment through a line.

A centrifuge of this type is known from GB Pat. No. 1 495 210. Since the closure compartment in this known centrifuge communicates with the atmosphere through at least one choking opening (p. 3, 11. 32–34), closure fluid must constantly be supplied to the closure compartment to maintain the valve body in the closing position. The choking opening also limits and reduces the rate at which the valve body opens.

SUMMARY OF THE INVENTION

The main object of the present invention is to provide a centrifuge of the aforesaid type in which the annular valve body opens and closes rapidly and in which a separation time that is longer than the emptying time results in lower control-water consumption.

This object is achieved in accordance with the present invention in a centrifuge of the aforesaid type wherein the line consists of two connected components that can be separated by a hydraulically switched piston and wherein the piston has a flowthrough channel that, in the separated position, connects the second line component, which opens into the closure compartment, with an off-flow channel that is open to the atmosphere.

The solids space of the the centrifuge in accordance with the invention is emptied by switching the piston over hydraulically so that the column of fluid in the first line component does not activate the annular valve body while the second line component and hence the closure compartment is depressurized through the piston flowthrough channel that constitutes a connection with the atmosphere. This sudden release of closure force on the annular valve body rapidly moves it, subject to the high pressure prevailing in the channels extending from the solids space, into the opening position. The motion of the valve body can also be reinforced by opening water introduced into an opening chamber associated with the valve body.

A preferred embodiment of the invention will now be described with reference to the attached drawings, wherein

DETAILED DESCRIPTION OF THE PREFERRED EMBODIMENTS

Figure 1:
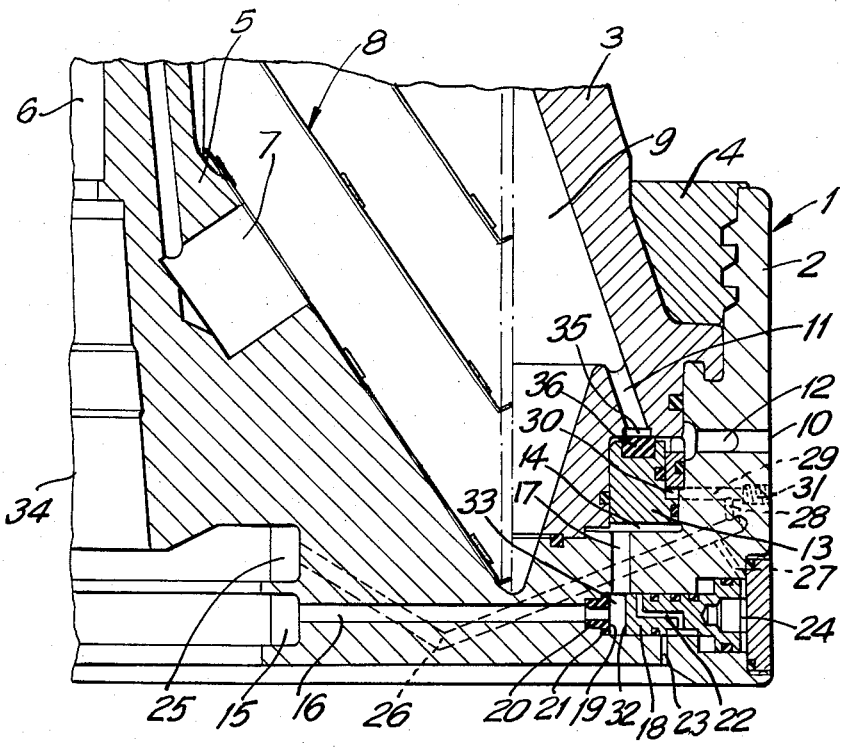
FIG. 1 is a partial vertical section through a centrifuge drum in accordance with the invention with an annular valve body in the closure position.
Figure 2:
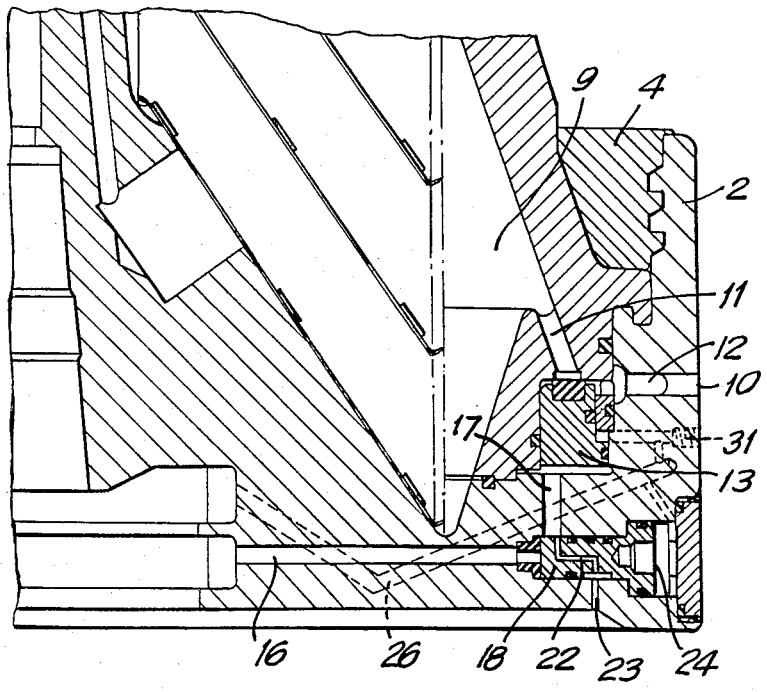
FIG. 2 a section like that in FIG. 1 but with the valve body in the opening position.

Referring to FIGS. 1 and 2, the drum 1 consists of a bottom 2, a cover 3, and a closure ring 4. The bottom 2 of the drum and the distributor 5 in the illustrated embodiment are in one piece. The liquid to be centrifuged is conveyed to an inlet chamber 6, whence it arrives, through bores that are not illustrated, in a vestibule 7 that communicates with the rising channels of a plate insert 8.

The solids that separate from the liquid accumulate in a solids space 9 as they separate.

There are openings 10, in the jacket of drum 1 through which the solids are ejected. Channels composed of channel components 11 and 12 lead to ejection openings 10. The two channel components can be separated by an annular valve body 13. The valve body in FIG. 1 is in the closure position, in which it separates channel component 11 from channel component 12. With valve body 13 is associated a closure compartment 14, which consists of communicating line components 16 and 17 and to which closure fluid is supplied from a catch gutter 15. Line components 16 and 17 can be separated by a hydraulically switched piston 18.

As will be evident from FIGS. 1 and 2, line component 16 extends from closure-fluid catch gutter 15 and terminates below closure compartment 14. There is an opening 19 facing the jacket of the drum in line component 16. Opening 19 is demarcated by a bushing 20 that has an annular stop flange 21 that limits the motion of piston 18. Piston 18 has a flowthrough channel 22. In the separating position illustrated in FIG. 2, flowthrough channel 22 connects second line component 17, which opens into closure compartment 14, with off-flow channel 23, which is open to the atmosphere.

Piston 18 is a differential piston and has an extensive active surface 24 that can be subjected to opening liquid, i.e. water supplied from a catch gutter 25 through channels 26 and 27. Channel 26 also communicates with channels 28 and 29 that lead to an opening chamber 30 associated with annular valve body 13. The channel 29 in the illustrated embodiment communicates through a choking opening 31 with the atmosphere.

Piston 18 also has a smaller active surface 32 that can block off the opening 19 in first line component 16 as illustrated in FIG. 2.

The part of piston 18 that has a shorter diameter is mounted in such a way that it can slide in a bore 33 in the bottom 2 of the drum. First line component 16 empties into the front of bore 33. Second line component 17 is between bore 33 and closure compartment 14.

The second line component 17 in the illustrated embodiment parallels the axis 34 around which the drum rotates. Piston 18 is in the vicinity of the jacket.

The channel components 11 that extend in the jacket from solids space 9 toward annular valve body 13 empty into an annular turn-out 35. In its closure position, valve body 13 rests with a rubber or plastic ring 36 secured in an anchoring groove on the edges of turn-out 35.

Valve body 13 is retained in the closure position illustrated in FIG. 1 while the liquid is being separated. No closure fluid is lost when the valve body is in this operating position. When valve body 13 is shifted into the opening position in order to empty solids space 9, however, piston 18 is moved by supplying opening water through channels 26 and 27 and charging large active surface 24 into the position illustrated in FIG. 2. In this position opening 19 is blocked off so that the column of fluid in line component 16 does not act on valve body 13. Since line component 16 extends from catch gutter 15 to below valve body 13 and is relatively long, pressure will build up to a considerable extent when piston 18 is switched over. Closure compartment 14 will simultaneously be depressurized through the connection between second line component 17 and the atmosphere through flowthrough channel 22 and off-flow channel 23. This also subjects opening chamber 30 with opening water, rapidly moving valve body 13 into the opening position. The solids will subsequently be extracted through the ejection openings 10 in the jacket of the drum.

The supply of opening water is interrupted to move valve body 13 into the closure position illustrated in FIG. 1. The pressure of the column in line component 16 will switch piston 18 over so that line components 16 and 17 are connected again and a high fluid pressure builds up in closure compartment 14, moving the valve body into the closure position. The opening water forced out of opening chamber 30 while valve body 13 is in motion flows off through choking opening 31.

It will be appreciated that the instant specification and claims are set forth by way of illustration and not limitation, and that various modifications and changes may be made without departing from the spirit and scope of the present invention.

What is claimed is:

1. In a centrifuge with a self-emptying drum, having a jacket with ejection openings communicating with a solids space through channels, an annular valve body for blocking the channels, and a closure compartment associated with the valve body and receptive of closure fluid through a line, the improvement wherein: the line comprises two connected line components a hydraulically actuated piston for separating the two line components, wherein the piston has a flowthrough channel therein and further comprising an off-flow channel that is open to the atmosphere and wherein the flowthrough channel connects the one line component which opens into the closure compartment with the off-flow channel when the piston is in the separating state.

2. The centrifuge as in claim 1, wherein the other line component has an opening facing the jacket of the drum and the piston comprises a differential piston and has an extensive active surface subjected to opening liquid and a smaller active surface for blocking off the opening.

3. The centrifuge as in claim 2, wherein the part of the piston having the smaller active surface is slidably mounted in a bore in the bottom of the drum, with the one line component emptying into the front of the bore and the other line component located between the bore and the closure compartment.

4. The centrifuge as in claim 2, wherein the opening in the one line component facing the jacket of the drum is demarcated by a bushing having an annular stop flange that limits the motion of the piston.

5. The centrifuge as in claim 1, wherein the one line component extends from a closure-fluid catch gutter and terminates below the closure compartment.

6. The centrifuge as in claim 1, wherein the other line component parallels the axis of rotation of the drum and the piston is in the vicinity of the jacket.

7. The centrifuge as in claim 1, further comprising an opening chamber associated with the annular valve body, wherein opening liquid is supplied simultaneously through channels to the opening chamber and to a control compartment associated with the extensive active surface of the piston, and wherein one of the channels communicates with the atmosphere through a choking opening.

8. The centrifuge as in claim 1, wherein the drum has a bottom and a cover and wherein the annular valve body is slidably mounted in an annular chamber delimited below and on the outside by the bottom of the drum and above and on the inside by the cover of the drum.

9. The centrifuge as in claim 8, further comprising an annular turn-out for the annular valve body and wherein the channels that extend in the jacket from the solids space toward the annular valve body empty into the annular turn-out and the valve body rests in its closure position with a ring secured in an anchoring groove on the edges of the turn-out.

* * * * *